United States Patent [19]

Gorman

[11] Patent Number: 4,640,722

[45] Date of Patent: Feb. 3, 1987

[54] HIGH TEMPERATURE FERRITIC STEEL

[75] Inventor: Mark D. Gorman, Lebanon, Ohio

[73] Assignee: Armco Inc., Middletown, Ohio

[21] Appl. No.: 704,752

[22] Filed: Feb. 25, 1985

Related U.S. Application Data

[63] Continuation-in-part of Ser. No. 560,129, Dec. 12, 1983, abandoned.

[51] Int. Cl.[4] ..... C22C 38/26; C22C 38/28

[52] U.S. Cl. ..... 148/325; 148/333; 148/334; 420/34; 420/67; 420/68; 420/69; 420/104; 420/105; 420/110; 420/111

[58] Field of Search ..... 148/37, 12 EA; 75/124 B, 124 C, 126 Q, 126 J, 126 D, 126 C, 126 F, 126 E, 126 G, 128 Z, 128 T, 246

[56] References Cited

U.S. PATENT DOCUMENTS

| | | | |
|---|---|---|---|
| 3,967,935 | 7/1976 | Frehn | 75/126 Q |
| 4,261,739 | 4/1981 | Douthett et al. | 148/37 |
| 4,286,986 | 9/1981 | Borneman | 75/126 F |

*Primary Examiner*—Melvyn J. Andrews
*Assistant Examiner*—Deborah Yee
*Attorney, Agent, or Firm*—Frost & Jacobs

[57] ABSTRACT

A ferritic alloy steel having good formability, cyclic oxidation resistance and creep strength at elevated temperatures above 1000° F. and particularly above about 1500° F. (816° C.) after a final anneal at 1850° to 2050° F. (1010° to 1120° C.), comprising 0.05% maximum carbon, about 2% maximum manganese, greater than 1.0% to 2.25% silicon, less than 0.5% aluminum, with silicon being at least 3 times the aluminum content, about 6% to about 25% chromium, up to about 5% molybdenum, with the sum of chromium and molybdenum being at least 8%, 0.05% maximum nitrogen, at least one of titanium, zirconium and tantalum, with said titanium, zirconium and tantalum being present in an amount at least equal to the stoichiometric equivalent of the present carbon plus the percent nitrogen, at least 0.1% uncombined columbium, and balance essentially iron.

11 Claims, 1 Drawing Figure

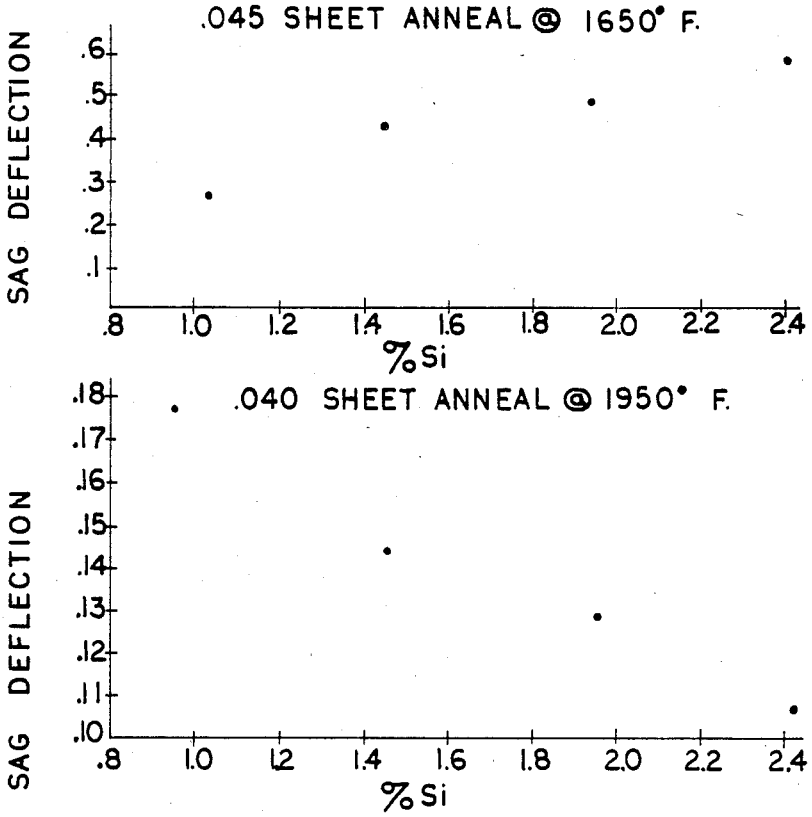
.045 SHEET ANNEAL @ 1650° F.
SAG DEFLECTION
.6
.5
.4
.3
.2
.1
.8
1.0
1.2
1.4
1.6
1.8
2.0
2.2
2.4
% Si
.040 SHEET ANNEAL @ 1950° F.
SAG DEFLECTION
.18
.17
.16
.15
.14
.13
.12
.11
.10
.8
1.0
1.2
1.4
1.6
1.8
2.0
2.2
2.4
% Si

HIGH TEMPERATURE FERRITIC STEEL

BACKGROUND OF THE INVENTION

This application is a continuation-in-part of application Ser. No. 560,129, filed Dec. 12, 1983, now abandoned.

This invention relates to a ferritic steel having improved cyclic oxidation resistance and creep strength at elevated temperature. More particularly, in the form of cold rolled strip, sheet, bar, rod and wire which has been subjected to a final anneal at 1850° to 2050° F. (1010° to 1120° C.), a preferred steel of the invention having a ferritic microstructure exhibits the above properties by reason of purposeful addition of silicon, a carbide and nitride former, and columbium within critical limits. Control of aluminum to a low value confers excellent weldability and formability without sacrifice of other properties. A synergistic improvement in creep strength and improved cyclic oxidation resistance at elevated temperature results from the combination of a silicon addition within the broad range of 0.8% to 2.25%, addition of sufficient carbide and nitride former to combine with substantially all the carbon and the nitrogen, addition of a small amount of columbium substantially all of which will be uncombined as a result of the carbide and nitride former addition, and a final high temperature anneal. The combination of properties is achieved throughout a wide range of chromium levels, viz. from about 1% to about 25%, but a fully ferritic microstructure may not be obtained at chromium plus molybdenum levels less than about 8%.

The automotive industry is a large user of flat rolled ferritic stainless steels for engine exhaust components. A standard stainless steel for this purpose has a nominal composition of about 0.03% maximum carbon, about 0.25% manganese, residual phosphorus and sulfur, about 0.5% silicon, about 12% chromium, about 0.2% nickel, about 0.4% titanium, about 0.1% maximum aluminum, about 0.02% maximum nitrogen, and balance essentially iron.

The present invention provides a substitute for the above stainless steel, having improved properties, not only for automotive exhaust components, but also for powder metal articles and welded articles.

A steel having substantially improved elevated temperature strength and oxidation resistance, in comparison to the above standard steel, is disclosed in U.S. Pat. No. 4,261,739. In broad ranges the steel of this patent consists essentially of, in weight percent, from about 0.01% to 0.06% carbon, about 1% maximum manganese, about 2% maximum silicon, about 1% to about 20% chromium, about 0.5% maximum nickel, about 0.5% to about 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron. A preferred steel in accordance with this patent has a nominal composition of about 0.02% carbon, about 0.25% manganese, about 0.02% phosphorus, about 0.005% sulfur, about 0.5% silicon, about 12.0% chromium, about 0.20% nickel, about 0.02% nitrogen, about 0.3% titanium, about 0.6% columbium, about 1.2% aluminum, and balance essentially iron. Such a preferred steel exhibits optimum elevated temperature strength and oxidation resistance in the cold rolled form when it is subjected to a final anneal at 1850° to 2050° F.

While this patent recognizes that aluminum in excess of about 1% can affect weldability adversely, relatively high aluminum levels, with a minimum of about 0.75%, must nevertheless be present in order to obtain the excellent elevated temperature oxidation resistance of this steel. Accordingly, the likelihood of poor weldability under some types of welding operations is present in the steel of this patent.

At column 8, lines 25–43 of U.S. Pat. No. 4,261,739 it is alleged that variations in aluminum content (between 0.77% and 1.33%) do not markedly affect sag resistance, and hence aluminum can be added at a level low enough to improve weldability. On the other hand, an increased aluminum content improves cyclic oxidation resistance. For an optimum balance of propertiers it is concluded that aluminum should be between about 1.0% and 1.5%.

Olsen Cup tests of welded sections, as a determination of formability, can exhibit considereable scatter in values due to the effects of sample thickness, welding speed, heating conditions, shielding gas and welding method. Thus, in U.S. Pat. No. 4,261,739, Olsen values for weldments, reported in Tables VII and X show little correlation between aluminum content and cup height. An aluminum content of 0.77% exhibited formability inferior to aluminum contents of 1.24%, 1.27% and 1.18% (Heats I, J, L and M in Table X), although superior to a 1.7% aluminum content (Table VII).

In U.S. Pat. No. 4,261,739, the titanium content is increased to compensate for a decreased aluminum content (Column 7, lines 54–57). However, silicon is maintained relatively constant within a range of about 0.45% to 0.6%. In every example of steels of the invention, aluminum is substantially higher than silicon.

In contrast to the above disclosures, the present invention constitutes a discovery that silicon can be substituted at least partially for aluminum and also partially for chromium, with a consequent improvement in weldability while at the same time retaining excellent oxidation resistance and creep strength at elevated temperature.

An article entitled "Influence of Columbium on the 870° C. Creep Properties of 18% Chromium Ferritic Stainless Steels" by J. N. Johnson, *SAE Technical Paper Series,* 810035, February 1981, reports tests on an 18% chromium steel containing molybdenum, titanium and columbium. In the test samples, silicon ranged from 0.08% to 0.74%, and uncombined columbium ranged from 0.11% to 0.58%. It was concluded on the basis of reported tests that a significant improvement in 870° C. creep strength of 18% chromium steels was obtained with the combination of about 0.5% free (uncombined) columbium and a high final annealing temperature at 925° to 1150° C. (about 1700° to about 2100° F.). In these test samples, aluminum was absent except in one sample which contained 1.89% aluminum, 0.71% silicon, 0.35% titanium and no columbium. This article contains no discussion regarding the effect of silicon or aluminum, other than reference to a Laves phase which, although primarily intermetallic compounds of iron-molybdenum or iron-columbium, may contain substitutional elements such as chromium, manganese and silicon.

"Effect of Molybdenum on Creep Properties of a Ferritic 18Cr-Nb-Ti Steel for Catalytic Converters", J. D. Redmond et al, *Journal of Metals,* Feb. 19, 1981, pages 19–25 reports the effect of molybdenum and columbium on creep-rupture properties of an 18% chromium steel. It is concluded that an additional strengthening mechanism in molybdenum-containing steels may result from the change in composition of the Laves phase where columbium decreases with increasing molybdenum contents. The displaced columbium is then available for further dispersion strengthening by carbide precipitation.

Ferritic, chromium-containing steels containing one or more of aluminum, titanium, columbium, silicon or zirconium are disclosed in U.S. Pat. Nos. 3,909,250; 3,782,925 and 3,759,705, and British Pat. No. 1,262,588. These alloys, while exhibiting improved oxidation resistance at elevated temperature, nevertheless have poor creep strength at elevated temperature and possible weldability problems.

Japanese Pat. No. 20,318 (published in 1977) and Japanese Pat. No. 107,761 (published in 1980) disclose ferritic alloys containing titanium and columbium, and tantalum, hafnium or tantalum plus zirconium, respectively. Neither suggests the presence of uncombined columbium in combination with silicon at a level greater than 1.0%.

NASA TN-D No. 7966 published in 1975, discloses modifications in 15% and 18% chromium ferritic steels wherein it was concluded that addition of 0.45% to 1.25% tantalum to a nominal 18% chromium, 2% aluminum, 1% silicon and 0.5% titanium steel provided the greatest improvement in fabricability, tensile strength and stress-to-rupture strength at 1800° F., along with oxidation resistance and corrosion resistance at elevated temperature. After cold rolling to final thickness, a final anneal at 1000° C. was conducted in the processing of these test alloys.

An article by H. E. Evans et al, in *Oxidation of Metals,* Vol. 19, Nos. ½, 1983, pages 1–18, describes the influence of silicon on the oxidation resistance of nitrided austenitic stainless steels of nominal 2% chromium–25% nickel composition. A series of such steels, also containing froim 0.005% to 0.050% carbon, 0.42% to 0.74% manganese, 1.44% to 1.56% titanium, and 0.05% to 0.21% columbium, was prepared with silicon levels ranging from 0.05% to 2.35%. Cold rolled strips were nitrided at 1423° K. (2102° F.) and tested for oxidation resistance at 1123° K. (1562° F.). It was found that chromium-rich oxide surface films developed in all cases, and the film thickness increased parabolically with time. The parabolic rate constant was at a minimum at 0.92% silicon. The reason for failure of higher silicon levels (about 1.5% to 2.35%) to improve oxidation resistance was postulated as being perhaps due to removal of silicon from solution by precipitation.

SUMMARY OF THE INVENTION

The present invention constitutes a discovery that improvement in weldability can be combined with excellent cyclic oxidation resistance and creep strength at elevated temperature above 1000° F. (538° C.) and particularly above 1500° F. (816° C.) in a ferritic steel. This is achieved in a preferred ferritic steel by substitution of silicon for at least part of the aluminum required in prior art steels having high oxidation resistance, by providing a relatively small content of uncombined columbium with reliance on titanium, zirconium, and/or tantalum to combine with carbon and nitrogen, and by subjecting the ferritic steel to a final anneal at 1850° to 2050° F. (1010° C. to 1120° C.). While the cyclic oxidation resistance at elevated temperature of the steel of the present invention is slightly inferior to that of the previously mentioned U.S. Pat. No. 4,261,739, creep strength of the present steel is approximately equal to that of said patent, and cyclic oxidation resistance and creep strength are substantially superior to that of the above-mentioned standard steel used for engine exhaust components which is commonly designated as Type 409.

It is an object of the present invention to provide a substantially ferritic steel at all temperatures having a wide chromium range which exhibits the combination of excellent oxidation resistance and strength at elevated temperature together with excellent weldability and which at the same time contains a minimum of expensive alloying ingredients.

According to the broadest aspect of the invention there is provided an alloy steel exhibiting good formability and improved cyclic oxidation resistance and creep strength at temperatures of at least 1500° F. (816° C.) after a final anneal at 1850° to 2050° F. (1010° to 1120° C.), consisting essentially of, in weight percent, 0.05% maximum carbon, about 2% maximum manganese, greater than 1.0% to 2.25% silicon, less than 0.5% aluminum, with silicon being at least 3 times the aluminum content, about 6% to about 25% chromium, up to about 5% molybdenum, with the sum of chromium and molybdenum being at least 8%, 0.05% maximum nitrogen, a carbide and nitride forming element chosen from the group consisting of titanium, zirconium and tantalum, said element being present in an amount at least equal to the stoichiometric equivalent of the percent carbon plus the percent nitrogen, at least 0.1% uncombined columbium, and balance essentially iron.

A preferred ferritic steel within the above broad ranges which combines the further desirable properties of weldability and formability, consists essentially of, in weight percent, about 0.03% maximum carbon, about 1% maximum manganese, greater than 1.0% to about 2.0% silicon, less than 0.5% aluminum, with silicon being at least 3 times the aluminum content, about 8% to about 20% chromium, about 0.5% maximum molybdenum, about 0.03% maximum nitrogen, about 0.5% maximum titanium with a minimum titanium content of 4 times the percent carbon plus 3.5 times the percent nitrogen, about 0.3% maximum total columbium, and balance essentially iron. Uncombined columbium will be understood to mean that which is not combined with carbon and/or nitrogen.

BRIEF DESCRIPTION OF THE DRAWING

Reference is made to the accompanying drawing which is a graphic comparison of sag resistance as a function of silicon content at two different final annealing temperatures.

DETAILED DESCRIPTION

As disclosed in the above-mentioned U.S. Pat. No. 4,261,739, conventional final annealing temperatures for ferritic steels range from about 1400° to about 1700° F. (760° to 925° C.). As was the case in that patent, it has been found that a higher final anneal within the range of 1850° to 2050° F. (1010° to 1120° C.) contributes significantly to improved elevated temperature creep strength in the steel of the present invention. Improvement in high temperature creep strength may be attributed to an increase in the final grain sizes, solid solution strengthening of the ferritic matrix, and the presence of carbide and nitride precipitates of titanium, zirconium, tantalum, and/or columbium which pin the grain boundaries, thus retarding the creep mechanism. A columbium-silicon rich Laves phase, which improves creep strength, apparently develops at a lower columbium level than obtained in U.S. Pat. No. 4,261,739 due to synergism with silicon and due to the presence of uncombined columbium.

Surprisingly, cyclic oxidation resistance is also dramatically improved due to the higher silicon level either with or without a higher final anneal.

A broad maximum of 0.05% carbon and 0.05% nitrogen must be observed in order to maintain a fully ferritic structure and to minimize the amounts of the carbide and nitride forming element or elements needed to stabilize the steel. Preferably carbon and nitrogen are each restricted to a maximum of about 0.03%.

Manganese could be present for its strengthening effect, but a broad maximum of about 2%, and a preferred maximum of 1%, should be observed, since it does not promote ferrite and may adversely affect the oxidation resistance of ferritic steels.

Phosphorus and sulfur may be present in the usual residual amounts without adverse effect.

Chromium may range between about 6% and 25% in order to obtain a desired level of corrosion and oxidation resistance at minimum cost, for a particular application. A preferred range of about 8% to about 20% chromium confers the properties usually associated with a ferritic stainless steel. It is a feature of the present invention that up to about 2% chromium is replaced by the purposeful silicon addition without loss of oxidation, especially cyclic, resistance.

Molybdenum additions are permitted up to about 5% to promote a ferritic structure at all temperatures. It also improves corrosion resistance and high temperature creep strength.

Silicon is essential within the broad range of greater than 1.0% to about 2.25%, with a preferred range of greater than 1.0% to about 2.0%. This silicon addition at least partially replaces aluminum or higher chromium levels used in prior art ferritic steels to provide high temperature (above 1500° F.) oxidation resistance, and the replacement of aluminum by silicon minimizes the detrimental effect of aluminum on weldability. For these functions the silicon content is at least 3 times the aluminum content. Silicon is of course a ferrite former.

Aluminum is restricted to a maximum of less than 0.5% for improved weldability. With titanium present, the nitrogen in the steel preferentially combines with titanium rather than aluminum, thereby avoiding the adverse effect of aluminum nitrides in causing porosity in weld areas.

A carbide and nitride forming element is added in an amount at least equal to the stoichiometric equivalent of the carbon plus nitrogen contents. Titanium is preferred and, if used, is present in a minimum amount of 4 times the percent carbon plus 3.5 times the percent nitrogen. Zirconium and/or tantalum may also be used as carbide and nitride forming elements along with, or in place of, titanium. A preferred maximum of 0.5% titanium should be observed with carbon and nitrogen each at a preferred maximum of 0.03%. When titanium, aluminum and columbium are present, titanium preferentially combines with nitrogen, and probably with carbon, although it is possible that some of the carbon may combine with columbium. The objective is to tie up as much as possible of the carbon and nitrogen with titanium or other carbide and nitride formers, leaving columbium present in uncombined form.

Uncombined columbium is essential, and the total columbium content is preferably limited to a maximum of 0.3%. At least 0.1% free or uncombined columbium is the minimum effective amount. For reasons explained above, the titanium addition permits the amount of total columbium addition to be minimized, which is advantageous from the standpoint of cost. The amount of uncombined columbium needed for increased creep strength at elevated temperature has been found to be relatively low, and as little as 0.10% and preferably about 0.20% uncombined columbium has been found to be effective for these purposes, due to the synergistic effect of the silicon addition.

The preferred maximum titanium is thus 0.5% and the preferred maximum total columbium is 0.3%, or a sum total of 0.8%. In contrast to this U.S. Pat. No. 4,261,739 permits up to 1.0% of either titanium or columbium with the proviso that the sum total does not exceed about 1.2%.

Nickel may be added in amounts up to about 5% where additional toughness is needed, if the level of ferrite formers is high enough to avoid excessive austenite formation, i.e., less than 10% austenite, and preferably less than 5%.

Any one or more of the preferred ranges indicated above can be used with any one or more of the broad ranges for the remaining elements set forth above.

A series of experimental heats of steels of the invention has been prepared and tested, along with comparative steels in which silicon or columbium are outside the ranges of the present invention. Comparative tests have also been run on Type 409 and on the steel of U.S. Pat. No. 4,261,739. The compositions of these steels are set forth in Table I.

Creep strength, as measured by sag resistance tests, is reported in Table II for 0.060 inch sheet at 1600° F., and in Table III for 0.045 inch sheet at 1500° F. It will be noted that several different final anneal temperatures were used, and the results show that a high temperature final anneal at 1850° to 2050° F. significantly improves the sag resistance and hence creep strength of the cold rolled sheet. Heats 6 and 7 in Table II exhibited improved creep strength after anneals at 1950° F. and 2050° F., respectively, in comparison to an anneal at 1850° F. In contrast to this, Heat 8, containing 0.44% silicon but otherwise within the composition limits of the steel of the invention, exhibited inferior sag resistance after an anneal at 1950° F., in comparison to an anneal at 1850° F. A representative steel of U.S. Pat. No. 4,261,739, was inferior to Heat 7 after a final anneal at 1950° F.

Referring to Table III, Heats 9 and 10, which contained 1.94% and 2.42% silicon respectively, but no columbium, were inferior to Heats 4 and 5 (containing columbium) in sag resistance at the annealing temperature of 1950° F.

Referring to the drawing it is noted that a series of non columbium bearing steels exhibited a substantial increase in sag resistance as silicon was gradually increased, when the steels were subjected to a final anneal at 1950° F. On the other hand when the same steels were subjected to a final anneal at 1650°, the sag resistance decreased with increasing silicon contents. In both cases the effect is substantially linear.

Table IV summarizes mechanical properties of Heats 4 and 5 under different final annealing conditions. It will be noted that the yield strength and tensile strength of samples subjected to annealing at 1950° F. are slightly lower than those annealed at 1650° F. but the elongation values are somewhat higher.

Table V summarizes Olson Cup values of Gas Tungsten Arc autogenous weldments of a steel of the invention and three comparative steels. It will be noted that the formability and ductility of the weld areas in the steel of the invention were relatively high. Heat 10, containing 2.42% silicon, exhibited low values, thus establishing criticality of the maximum of 2.25% silicon. Heat 11, a steel of U.S. Pat. No. 4,261,739, was inferior to the steels of the invention in weldability due to its aluminum content of 0.91%.

Table VI contains cyclic oxidation resistance test results conducted at 1700° F. while Table VII contains similar test results conducted at 1750° F. The use of cyclic oxidation resistance tests rather than static tests is believed to simulate more closely the particular application of the steel of the present invention for engine exhaust components. Accordingly, improved cyclic oxidation resistance is of greater significance than static oxidation resistance. It is evident from Tables VI and VII that Heats 4 and 5, these being steels of the invention, have cyclic oxidation resistance substantially superior to that of Heat 12 which is the conventional Type 409 alloy currently used for engine exhaust components. On the other hand, Heat 11 which is a steel of U.S. Pat. No. 4,261,739, is definitely superior to all the steels which were tested.

The invention further provides a welded article for high temperature service fabricated from alloy steel strip, sheet, plate, bar, rod and wire, which has been subjected to a final anneal at 1850° to 2050° F. and exhibiting improved formability, cyclic oxidation resistance and creep strength at temperatures of at least 1500° F.

Automotive exhaust components for high temperature service are provided by the invention fabricated from alloy steel having the broad composition set forth above and exhibiting improved cyclic oxidation resistance and creep strength at temperatures of at least 1500° F.

The invention also provides forged, cast and powder metal articles having the broad composition set forth above. Improved cyclic oxidation resistance and creep strength at temperatures of at least 1500° F. are obtained in ferritic articles of the above type where chromium ranges from about 6% to 25%, chromium plus molybdenum total at least 8%, and at least 0.1% uncombined columbium is present.

The steel of the present invention achieves the objective of providing improved cyclic oxidation resistance and creep strength at elevated temperature, in comparison to the conventional Type 409, together with improved weldability and creep strength as compared to the steel of U.S. Pat. No. 4,261,739 with a reduction in expensive columbium as allowed by the discovery of the unique synergistic effect introduced by silicon when present in the alloys of this invention.

TABLE I

| | Compositions - Weight Percent | | | | | | | | | | |
|---|---|---|---|---|---|---|---|---|---|---|---|
| Heat No. | C | Mn | P | S | Si | Cr | Ni | Al | Ti | N | Cb |
| 1 | .023 | .27 | .023 | .016 | 1.18 | 6.49 | .19 | .026 | .35 | .014 | — |
| 2 | .022 | .28 | .021 | .016 | 1.18 | 8.21 | .19 | .027 | .35 | .012 | — |
| 3 | .025 | .26 | .022 | .016 | 1.13 | 9.88 | .18 | <.020 | .21 | .012 | — |
| 4* | .019 | .28 | .023 | .010 | 1.09 | 10.27 | .18 | .028 | .31 | .016 | .15 |
| 5* | .020 | .28 | .022 | .010 | 1.10 | 10.19 | .19 | .030 | .33 | .018 | .29 |
| 6* | .020 | .40 | .020 | .005 | 1.03 | 11.27 | .43 | .024 | .22 | .015 | .19 |
| 7* | .019 | .40 | .020 | .005 | 1.53 | 11.27 | .43 | <.020 | .18 | .015 | .19 |
| 8 | .019 | .40 | .020 | .005 | .44 | 11.27 | .43 | .024 | .24 | .015 | .19 |
| 9 | .015 | .27 | .021 | .011 | 1.94 | 11.04 | .20 | .052 | .41 | .016 | — |
| 10 | .018 | .27 | .021 | .010 | 2.42 | 11.06 | .20 | .049 | .43 | .014 | — |
| 11** | .030 | .33 | .016 | .011 | .70 | 11.66 | .22 | .91 | .44 | .016 | .52 |
| 12*** | .014 | .28 | .019 | .002 | .58 | 11.15 | .17 | .060 | .41 | .012 | — |
| 13 | .015 | .26 | .022 | .011 | 1.45 | 11.08 | .20 | .047 | .35 | .015 | — |

*Steels of the invention
**Steel of U.S. Pat. No. 4,261,739
***Type 409

From the above description it is evident that the invention includes within its scope alloy steel strip, sheet, plate, bar, rod and wire annealed at 1850° to 2050° F. having the above broad composition which exhibits improved cyclic oxidation resistance and creep strength at temperatures above 1000° F. Good results are obtained at temperatures of at least 1500° F. and up to about 1600° F. or higher in the alloys of the invention, i.e. where chromium is from about 6% to 25%, chromium plus molybdenum total at least 8%, and at least 0.1% uncombined columbium is present.

An embodiment exhibiting an optimum combination of properties consists essentially of 0.03% maximum carbon, about 1% maximum manganese, about 1.4% silicon, less than 0.5% aluminum, about 11% chromium, 0.03% maximum nitrogen, about 0.5% maximum titanium with a minimum titanium content of 4 times the percent carbon plus 3.5 times the percent nitrogen, about 0.2% uncombined columbium, and balance essentially iron.

TABLE II

| Sag Resistance - 1600° F. 0.060" Sheet | | | |
|---|---|---|---|
| | | Sag Deflection - Inch | |
| Heat No. | % Si | 20 hrs. | 100 hrs. |
| | 1850° F. Final Anneal | | |
| 6* | 1.03 | 0.065 | 0.160 |
| 7* | 1.53 | 0.058 | 0.135 |
| 8 | 0.44 | 0.283 | 0.887 |
| | 1950° F. Final Anneal | | |
| 6* | 1.03 | 0.048 | 0.112 |
| 7* | 1.53 | 0.029 | 0.069 |
| 8 | 0.44 | 0.591 | >1.350 |
| Steel of USP 4,261,739 | | 0.05 | 0.10 |
| | 2050° F. Final Anneal | | |
| 6* | 1.03 | 0.027 | 0.061 |
| 7* | 1.53 | 0.028 | 0.058 |
| 8 | 0.44 | 0.258 | 0.742 |

*Steels of the invention

TABLE III

| Heat No. | % Si | Sag Deflection - Inch 20 hrs. | 100 hrs. |
|---|---|---|---|
| | Sag Resistance - 1500° F. | | |
| | 1650° F. Final Anneal | | |
| 3* | 1.13 | .136 | .262 |
| 9* | 1.94 | .225 | .474 |
| 10 | 2.42 | .328 | .561 |
| 13* | 1.45 | .193 | .420 |
| | 1950° F. Final Anneal | | |
| 4** | 1.09 | .031 | .052 |
| 5** | 1.10 | .045 | .067 |
| 9 | 1.94 | .072 | .128 |
| 10 | 2.42 | .051 | .107 |
| 13 | 1.45 | .083 | .143 |

Average of duplicate samples - samples .045" sheet except 9 and 10 which were 0.040" sheet.
*annealing treatment outside of invention
**Steels of the invention

TABLE IV

| Heat No. | Final Anneal °F. | Mechanical Properties 0.2% Y.S. ksi | U.T.S. ksi | % Elong. in 2" | Hardness $HR_B$ |
|---|---|---|---|---|---|
| 4 | 1650 | 39.7 | 67.2 | 32.5 | 75.5 |
| 4* | 1950 | 36.1 | 61.6 | 34.5 | 74 |
| 5 | 1650 | 48.6 | 75.6 | 24 | 81.5 |
| 5* | 1950 | 37.3 | 82.3 | 25.5 | 79.5 |

*Steels of the invention

TABLE V

| Heat No. | Olsen Values - Welds Orientation | Cup Height - In. |
|---|---|---|
| 3 | Root | .368 |
| | Face | .358 |
| 5* | Root | .335 |
| | Face | .353 |
| 10 | Root | .215 |
| | Face | .318 |
| 11 | Root | .203 |
| | Face | .181 |

*Steels of the invention

TABLE VI

| Heat No. | Cyclic Oxidation Resistance - 1700° F. Weight Gain in mg/cm² Cycles 142 | 274 | 373 | 613 | 948 |
|---|---|---|---|---|---|
| 1 | 6.89 | 10.51 | 12.54 | 20.94 | 41.59 |
| 2 | .45 | .69 | .82 | .98 | 1.18 |
| 3 | .26 | .35 | .38 | .44 | .50 |
| 5* | .38 | .52 | .65 | .73 | .85 |
| 9 | .42 | .60 | .76 | .88 | 1.01 |
| 10 | .46 | .66 | .70 | .96 | 1.06 |
| 11 | .16 | .15 | .17 | .19 | .23 |
| 12 | .83 | — | 1.21 | 2.22 (after 752 cycles) | |

Average of duplicate samples
*Steels of the invention

TABLE VII

| Heat No. | Cyclic Oxidation Resistance - 1750° F. Weight Gain in mg/cm² Cycles 59 | 240 |
|---|---|---|
| 1 | 30.70 | 80.33 |
| 2 | 3.05 | 8.06 |
| 3 | 3.02 | 4.10 |
| 4* | .34 | .69 |
| 5* | .38 | .69 |
| 9 | .39 | .70 |

TABLE VII-continued

| Heat No. | Cyclic Oxidation Resistance - 1750° F. Weight Gain in mg/cm² Cycles 59 | 240 |
|---|---|---|
| 10 | .38 | .70 |
| 11 | .30 | .31 |
| 12 | 8.59 | 28.50 |

Average of duplicate samples except Ht. 11
*Steels of the invention

I claim:

1. Annealed ferritic steel exhibiting improved cyclic oxidation resistance and creep strength at temperatures of at least 816° C., after a final anneal at 1010° to 1120° C. which develops a columbium-silicon rich Laves phase, consisting essentially of, in weight percent, 0.05% maximum carbon, about 2% maximum manganese, greater than 1.0% to about 2.25% silicon, less than 0.5% aluminum, with the silicon content being at least 3 times the aluminum content, about 6% to about 25% chromium, up to about 5% molybdenum, with the sum of chromium and molybdenum being at least 8%, 0.05% maximum nitrogen, at least one of titanium, zirconium and tanalum, with said titanium, zirconium and tantalum being present in an amount at least equal to the stoichiometric equivalent of the percent carbon plus the percent nitrogen, about 0.3% maximum total columbium with at least 0.1% uncombined columbium, and balance essentially iron.

2. The steel claimed in claim 1, consisting essentially of about 0.03% maximum carbon, about 1% maximum manganese, greater than 1.0% to about 2.0% silicon, less than 0.5% aluminum, about 8% to about 20% chromium, about 0.5% maximum molybdenum, about 0.03% maximum nitrogen, about 0.5% maximum titanium with a minimum titanium content of 4 times the percent carbon plus 3.5 times the percent nitrogen, and balance essentially iron.

3. The steel claimed in claim 1, consisting essentially of, 0.03% maximum carbon, about 1% maximum manganese, about 1.4% silicon, less than 0.5% aluminum, about 11% chromium, 0.03% maximum nitrogen, about 0.5% maximum titanium with a minimum titanium content 4 times the percent carbon plus 3.5 times the percent nitrogen, about 0.2% uncombined columbium, and balance essentially iron.

4. The steel of claim 1, including up to about 5% nickel.

5. The steel of claim 1, wherein said uncombined columbium is at least about 0.2%.

6. Alloy steel strip, sheet, plate, bar, rod and wire annealed at 1010° to 1120° C. with resultant development of a columbium-silicon rich Laves phase, which exhibits improved oxidation resistance and creep strength at temperatures of at least 816° C., said steel consisting essentially of, in weight percent, 0.05% maximum carbon, about 2% maximum manganese, greater than 1.0% to about 2.25% silicon, less than 0.5% aluminum, with the silicon content being at least 3 times the aluminum content, about 6% to about 25% chromium, up to about 5% molybdenum, with the sum of chromium and molybdenum being at least 8%, 0.05% maximum nitrogen, at least one of titanium, zirconium and tantalum, with said titanium, zirconium and tantalum being present in an amount at least equal to the stoichiometric equivalent of the percent carbon plus the percent nitrogen, about 0.3% maximum total columbium with at least 0.1% uncombined columbium, and balance essentially iron.

7. Alloy steel strip, sheet, plate, bar, rod and wire as claimed in claim 6, wherein said steel consists essentially of about 0.03% maximum carbon, about 1% maximum manganese, greater than 1.0% to about 2.0% silicon, less than 0.5% aluminum, about 8% to about 20% chromium, about 0.5% maximum molybdenum, about 0.03% maximum nitrogen, about 0.5% maximum titanium with a minimum titanium content of 4 times the percent carbon plus 3.5 times the percent nitrogen, and balance essentially iron.

8. Automotive exhaust components for high temperature service fabricated from an alloy steel which has been subjected to a final anneal at 1010° to 1120° C. with resultant development of a columbium-silicon rich Laves phase, and exhibiting improved cyclic oxidation resistance and creep strength at temperatures of at least 816° C., said steel consisting essentially of, in weight percent, 0.05% maximum carbon, about 2% maximum manganese, greater than 1.0% to about 2.25% silicon, less than 0.5% aluminum, with the silicon content being at least 3 times the aluminum content, about 6% to about 25% chromium, up to about 5% molybdenum, with the sum of chromium and molybdenum being at least 8%, 0.05% maximum nitrogen, at least one of titanium, zirconium and tantalum, with said titanium, zirconium and tantalum being present in an amount at least equal to the stoichiometric equivalent of the percent carbon plus the percent nitrogen, about 0.3% maximum total columbium with at least 0.1% uncombined columbium, and balance essentially iron.

9. Automotive exhaust components as claimed in claim 8, wherein said steel consists essentially of about 0.03% maximum carbon, about 1% maximum manganese, greater than 1.0% to about 2.0% silicon, less than 0.5% aluminum, about 8% to about 20% chromium, about 0.5% maximum molybdenum, about 0.03% maximum nitrogen, about 0.5% maximum titanium with a minimum titanium content of 4 times the percent carbon plus 3.5 times the percent nitrogen, and balance essentially iron.

10. Forged, cast and powder metal articles annealed at 1110° to 1120° C. to develop a columbium-silicon rich Laves phase, consisting essentially of, in weight percent, 0.05% maximum carbon, about 2% maximum manganese, greater than 1.0% to about 2.25% silicon, less than 0.5% aluminum, with the silicon content being at least 3 times the aluminum content, about 6% to about 25% chromium, up to about 5% molybdenum, with the sum of chromium and molybdenum being at least 8%, 0.05% maximum nitrogen, at least one of titanium, zirconium and tantalum, with said titanium, zirconium and tantalum being present in an amount at least equal to the stoichiometric equivalent of the percent carbon plus the percent nitrogen, about 0.3% maximum total columbium with at least 0.1% uncombined columbium, and balance essentially iron.

11. Forged, cast and powder metal articles as claimed in claim 10, consisting essentially of about 0.03% maximum carbon, about 1% maximum manganese, greater than 1.0% to about 2.0% silicon, less than 0.5% aluminum, about 8% to about 20% chromium, about 0.5% maximum molybdenum, about 0.03% maximum nitrogen, about 0.5% maximum titanium with a minimum titanium content of 4 times the percent carbon plus 3.5 times the percent nitrogen, and balance essentially iron.

* * * * *